United States Patent [19]

Virtanen

[11] 3,995,715

[45] Dec. 7, 1976

[54] PROTECTIVE COVERING FOR SCAFFOLDING

[75] Inventor: Uolevi Eerikki Virtanen, Makitie, Finland

[73] Assignee: A. Ahlstrom Osakeyhtio, Kauttua, Finland

[22] Filed: Sept. 10, 1975

[21] Appl. No.: 612,023

[52] U.S. Cl. ..... 182/129; 182/47

[51] Int. Cl.[2] ..... E04G 21/38; E04B 1/343

[58] Field of Search ..... 182/129, 47; 52/63

[56] References Cited

UNITED STATES PATENTS

| | | | |
|---|---|---|---|
| 601,805 | 4/1898 | Cook | 24/243 K |
| 3,424,179 | 1/1969 | Minot | 52/63 |
| 3,762,110 | 10/1973 | Boss | 52/63 |

*Primary Examiner*—Reinaldo P. Machado
*Attorney, Agent, or Firm*—Cushman, Darby & Cushman

[57] ABSTRACT

In combination with a scaffolding a plurality of sheets of plastic having bead portions, profiles surrounding the bead portions of each two abutting sheet edges thereby securing the sheets to each other. A plurality of attachment members partly surrounds the profiles and holds the profiles in related assembly with the scaffolding.

4 Claims, 3 Drawing Figures

PROTECTIVE COVERING FOR SCAFFOLDING

This invention relates to scaffolding of the type commonly installed adjacent to a wall of a building and the like, and more particularly to a covering secured to the scaffolding for the purpose of protecting workmen on the scaffolding during severe weather conditions.

For work shelters at building sites, use is nowadays usually made of sheets of plastic for the attachment of which use is made of frames on both sides of the sheets or merely of vertical ribbing at from 0.5 to 2 meter division. In the latter case the covering is collected into a roll and unrolled when being attached to the scaffolding. The attaching of the covering to the supporting ribs is effected by means of tied strings. There is a third way of attaching which is by attaching vertical runners to the scaffolding at 1.5 to 2 meter intervals, to which the covering is nailed by means of an external horizontal ribbing.

The described known methods have various disadvantages of their own. A covering fixed to a supporting frame is difficult to handle, especially at great heights, where it can be directly affected by the wind. Coverings attached by means of vertical or horizontal ribs can only be used once, and it is difficult to fasten them, and they consequently become expensive and in the seams produced by overlapping part of the area of the covering is lost. A feature common to all these methods is that the seams cannot be made completely rainproof or dust-proof.

The U.S. Pat. No. 3,121,470 discloses a covering secured to a scaffolding in which vertical side edges of each sheet is partially wrapped about an adjacent vertical tubular member of the scaffolding. The sheets are secured to the members with elongated metal securing strips and clamps holding the strip and the sheet edges against the tubular member. This known device has mainly two drawbacks. Firstly, the width of each sheet has to correspond to the distance between adjacent vertical uprights and, secondly, each sheet has to be of a length sufficient to cover the height of the exposed side of the scaffolding.

An object of the present invention is to avoid these disadvantages and to provide an improved means for detachably securing a protective covering of sheet material to the frame of the scaffolding.

An other object of the invention is to provide an improved cover construction which may be readily assembled and disassembled without the need of special skill or techniques.

With the foregoing and other objects and advantages in view the invention consists in the preferred construction and arrangement of the several parts which will be hereinafter fully described and claimed.

Figure 3:
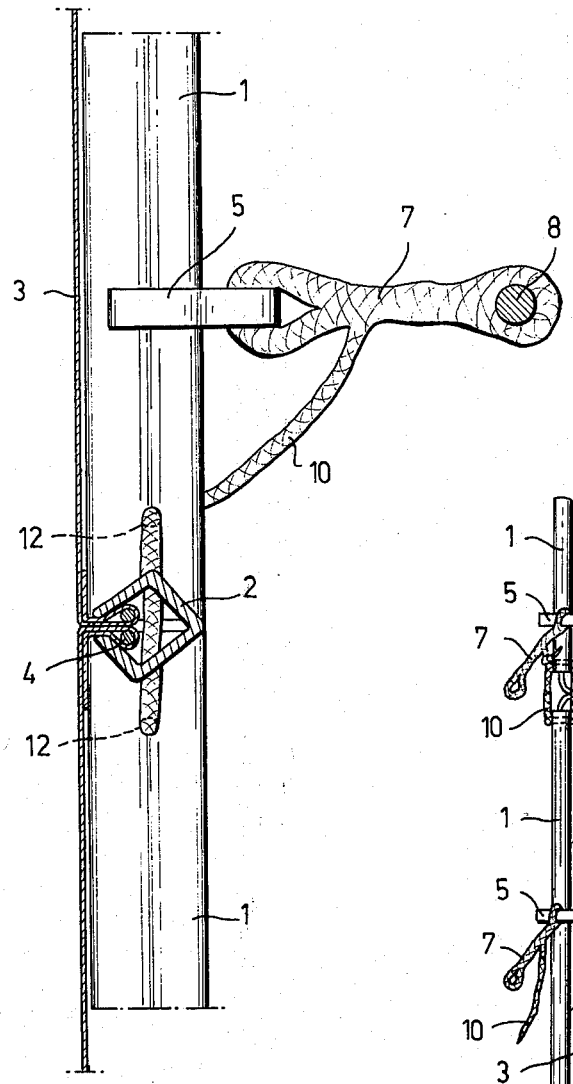
FIG. 3 is a vertical section taken along the line III—III of FIG. 2.
Figure 1:
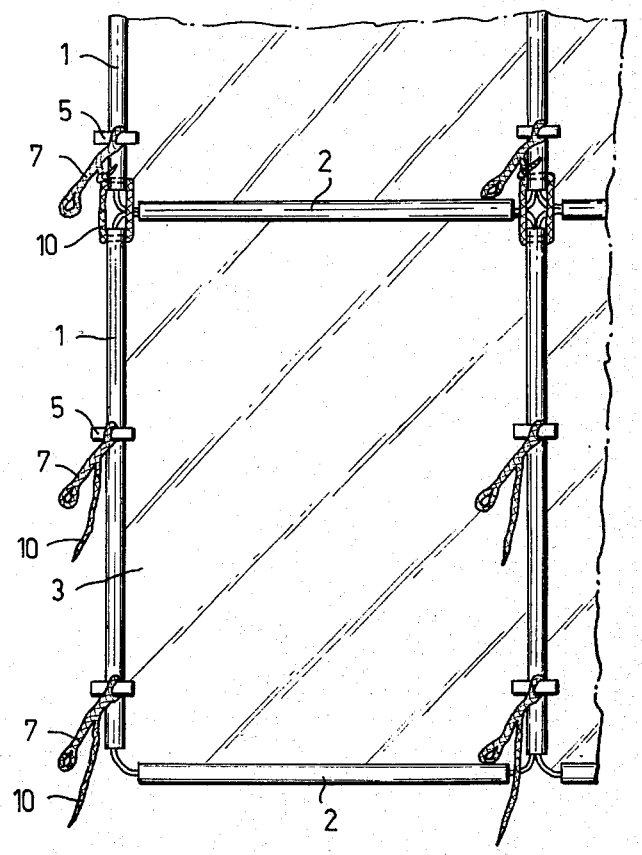
FIG. 1 is a front elevation of a corner of a ready-assembled covering prior to its attachment to the scaffolding.
Figure 2:
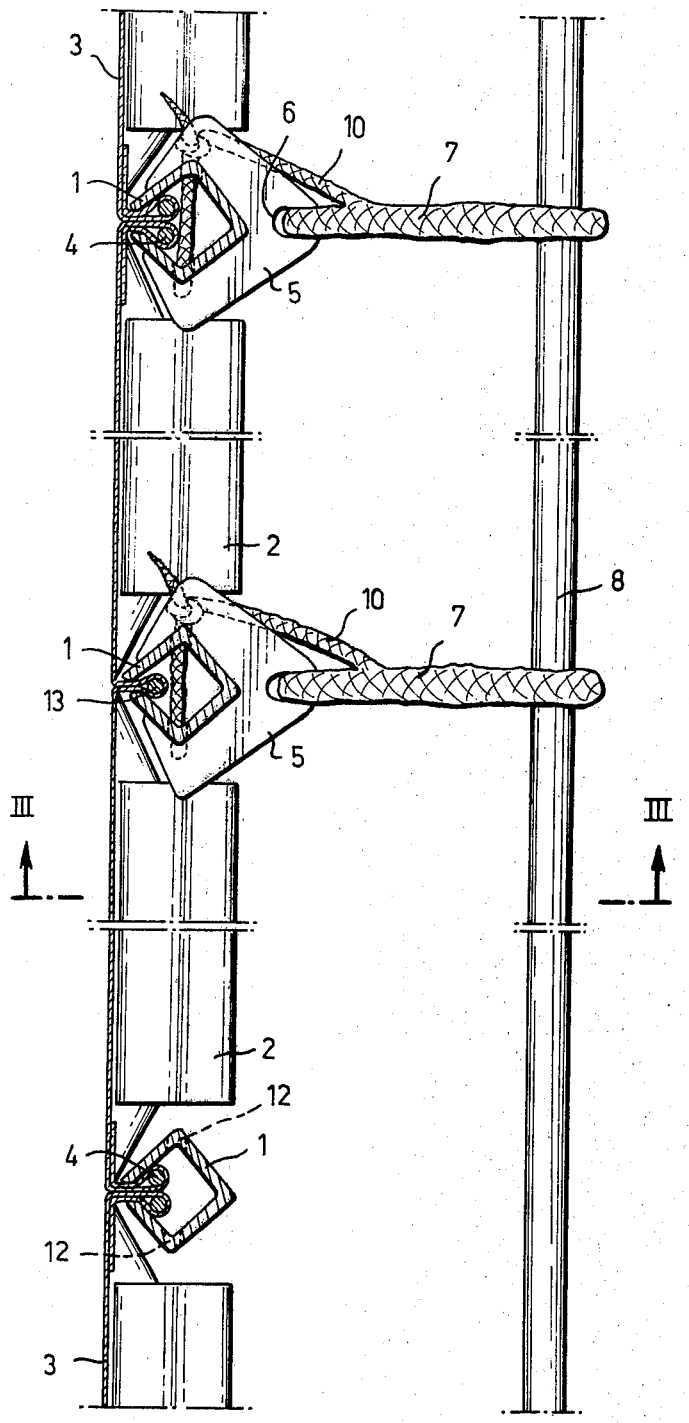
FIG. 2 is an enlarged horizontal sectional view illustrating the manner in which sheets of the protective covering are secured to members of the scaffolding, the attachment member with its strings having been omitted from the bottom profile.

The supporting structure for the covering shown in the Figures consists of vertical tubular profiles 1 and horizontal tubular profiles 2, which are square in cross-section and in which one corner has been split so as to form a slot the length of the profile. Cylindrical beads 4 have been attached to the edges of the covering sheets 3 by folding the edge-zone of the sheets around the beads and attaching the edges to the sheet. Onto the vertical tubular profiles 1 resilient attachment members 5 have been pushed so as to fit snugly in place with compression tightness these members having a hole 6 for an attaching string 7 by which the supporting structure of the covering is attached to horizontal or vertical members 8 of the scaffolding. The consecutive vertical tubular profiles 1 are attached to one another by means of an end 10 of the attachment string 7, which have been taken through one hole 12 in each of the tubular profiles concerned. For possible attachment of the tubular profiles at places between the edges of the tarpaulin units 3, use is moreover made of loose beads 13, see FIG. 2.

The assembly of the covering and its attachment to the scaffolding is effected in the following manner:

The covering sheets 3, lying on the ground with the beads 4 at the edges are attached together by pushing the tubular profiles 1 and 2 over adjacent beads of different covering sheets. Because the slot of the tubular profile is narrower than the beads, these will become locked inside the profile and thus effectively fix the covering sheets together. As the covering sheets are usually fairly large, e.g. 3 × 5 or 5 × 5 meters, they must generally also be supported at places between the edges. This is done by placing a loose bead 13 on the outer side of the sheet and forming a small fold of sheet around it so that a tubular profile can be pushed over the bead. In this way the covering can be attached, for instance, to the vertical tubular profiles 1, which are located at a suitable distance, say 1 meter, from one another.

The consecutive vertical tubular profiles 1 are attached to one another by pushing one end of the attachment string 7 through the holes 12 of two consecutive profiles, in the manner indicated in the drawing. The attachment string 7 is advantageously plied plastic string, and the ends can be made suitably stiff by heating them so that they partially melt.

The covering is assembled on the ground in this manner, for instance to the size of the outer side of the scaffolding, is folded together and lifted by crane to the appropriate height. When the covering has been lifted to the point at which the scaffolding is, the bundle is opened progressively. Attachment members 5 are then moved along the vertical profiles 1 to a position opposite steel pipes 8 of the scaffolding, after which the strings 7 are attached to the pipes 8.

When the covering is no longer needed, it is detached from the scaffolding, gathered into a bundle and lowered to the ground, where it can be extended or reduced in size for its following use as needs may be. In connection with this handling the covering is retained quite unbroken and can consequently be utilized again and again.

Since the covering according to the present invention is formed of a plurality of sheets, the size of the covering is readily adjustable. The height of the individual sheets need not correspond to any given distance between horizontal members of the scaffolding because the attachment members 5 can readily be pushed along the vertical profiles to a point where they can be fastened to a horizontal member of the scaffolding. Also, the width of the sheets need not correspond to the distance between vertical members of the scaffolding, because the attachment members are normally fastened to horizontal pipes. A given covering according to the present invention can therefore be used together with scaffoldings of the most different structure.

The covering is preferably made of soft plastic, while the profiles and the attachment members are most suitably of stiff plastic. The beads 4 and 13 are preferably made of plastic hose, plastic-covered string or the like.

The drawing and the description relating thereto are merely intended to illustrate the idea of the invention, and it is to be noted that the device according to the invention may vary considerably in detail within the scope of the attached patent claims. Thus, for the locking of consecutive vertical profiles to each other, other locking means than those described can be used, and in some cases the horizontal profiles 2 may be entirely omitted and the seam created by means of overlapping alone. When horizontal profiles are used, they too can be equipped with attachment members when desired. The profiles can have circular cross-section.

What I claim is:

1. In combination with a scaffolding comprised of interconnected vertically and horizontally disposed members forming a skeleton frame, a covering constructed of a plurality of sheets of plastic having bead portions of cylindrical form on each edge of each sheet, vertically and horizontally disposed elongated tubular profiles each having a slot opening from the interior through the wall of the profile, the slots having a width less than the diameter of the interior of the profiles, each profile surrounding the bead portions of two abutting sheet edges thereby securing the sheets to each other, the length of each tubular profile corresponding substantially to the length of the respective sheet edges to which it is fastened, said sheets and their respective tubular profiles being arranged so that at a corner of a sheet two profiles are disposed in end-to-end relationship, and flexible attaching means attaching the ends of said two profiles to facilitate folding of the covering at the location of said flexible attaching means, and a plurality of resilient attachment members partly surrounding the profiles and provided with a string for holding the profiles in related assembly with adjacent members of the scaffolding at spaced intervals along the length of the profiles.

2. A device as set forth in claim 1, wherein the attachment members fit onto the tubular profiles with compression tightness.

3. A device as set forth in claim 1, wherein the profiles have a quadratic cross-section the slot being in one corner of the cross-section and the attachment members surrounding the three other corners.

4. A device as in claim 1 wherein said flexible attaching means includes a flexible string passing through holes in the end-to-end tubular profiles.

* * * * *